United States Patent [19]

Hood et al.

[11] 4,332,626

[45] Jun. 1, 1982

[54] METHOD FOR REMOVING LIQUID RESIDUES FROM VESSELS BY COMBUSTION

[75] Inventors: Oscar L. Hood, Beaumont; Irvin V. Lytton, Dickinson, both of Tex.

[73] Assignee: PPG Industries, Inc., Pittsburgh, Pa.

[21] Appl. No.: 256,437

[22] Filed: Apr. 22, 1981

Related U.S. Application Data

[63] Continuation-in-part of Ser. No. 72,703, Sep. 4, 1979, abandoned.

[51] Int. Cl.[3] ..... B08B 9/08

[52] U.S. Cl. ..... 134/11; 110/236; 134/19; 134/22.1

[58] Field of Search ..... 134/11, 19, 22 R, 2; 110/236, 238, 346; 432/224

[56] References Cited

U.S. PATENT DOCUMENTS

| | | | |
|---|---|---|---|
| 1,040,410 | 10/1912 | Rauch et al. | 432/224 |
| 1,125,930 | 1/1915 | Arnemann | 432/224 |
| 1,901,803 | 3/1933 | Davis | 134/2 X |
| 2,507,685 | 5/1950 | Wilde | 432/224 X |
| 3,163,134 | 12/1964 | Stratford | 134/22 R |
| 3,219,108 | 11/1965 | Monroe | 134/22 R |
| 3,428,435 | 2/1969 | Hurko et al. | 134/19 X |
| 3,590,756 | 7/1971 | Erman | 110/236 X |
| 4,022,639 | 5/1977 | Ueki | 134/22 R |
| 4,136,624 | 1/1979 | Kato et al. | 134/22 R X |

*Primary Examiner*—Marc L. Caroff

*Attorney, Agent, or Firm*—Irwin M. Stein

[57] ABSTRACT

Oxidizable liquid organic chemical residues are removed from large vessels by a non-catalytic method comprising:

a. heating the vessel by introducing a heat source and oxygen into the interior of the vessel, the emitted heat being sufficient to volatilize substantially all and decompose at least a portion of said oxidizable liquid organic chemical contaminating the interior of said vessel;

b. exhausting from the vessel combustion gas resulting from the volatilization and decomposition of the liquid organic chemical during the heating step;

c. filtering particulates from the combustion gas and decomposing with heat any volatilized organic chemical remaining in the combustion gas exhausted from the vessel; and d. venting to the atmosphere combustion gas essentially free of said particulates and oxidizable organic chemical.

16 Claims, 1 Drawing Figure

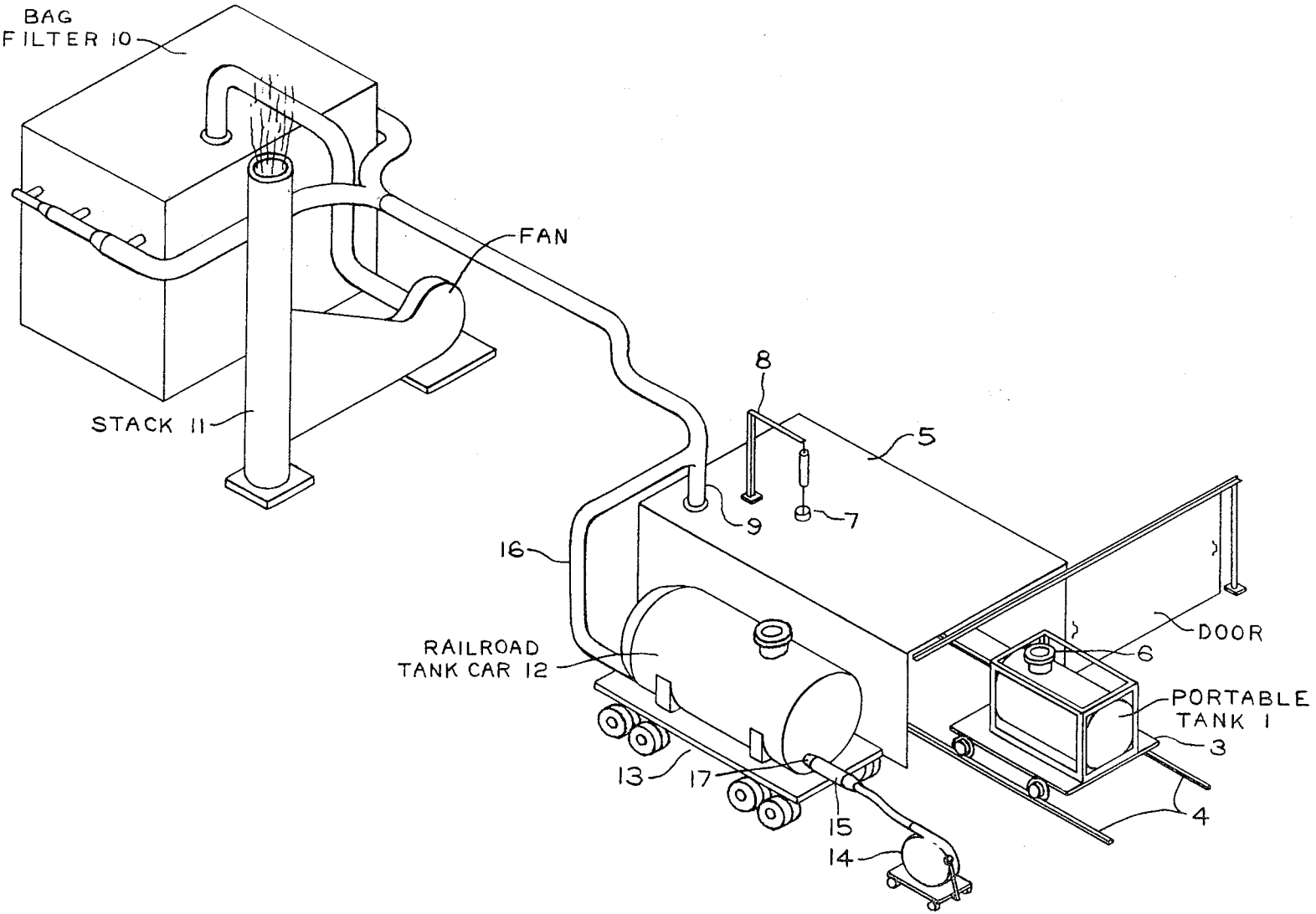
DOOR
PORTABLE TANK 1
3
4
6
5
7
8
9
15
14
17
13
16
RAILROAD TANK CAR 12
FAN
BAG FILTER 10
STACK 11

METHOD FOR REMOVING LIQUID RESIDUES FROM VESSELS BY COMBUSTION

This application is a continuation-in-part application of Ser. No. 072,703, filed Sept. 4, 1979, now abandoned.

BACKGROUND OF THE INVENTION

Some chemicals, e.g., liquid organic chemicals, although they are useful, are also hazardous to humans and other life forms. As a result, they must be specially handled during process, storage and transportation. Suitable handling provisions are designed by taking a range of the properties of the hazardous chemicals, measuring the extent of each, determining the hazard associated with each, and then correlating these properties with the technology available for appropriate hazard control. Properly equipped vessels can adequately process, transport and store such hazardous chemicals. Linings, for example, are used to protect the product from contamination and protect the vessel from attack by the product or from leakage via the porosity of the vessel material.

In the event of damage or extensive wear, these vessels must be taken out of service until refurbished or they must be condemned for disposal. Condemnation occurs because of a worn out vessel body, fittings, insulation or structures to which these vessels are permanently or semipermanently attached, and more especially because of damaged linings. Also, physical damage may occur to the vessel or its structure such as by expansion, contraction, weather, motion, momentum, accidental impact and the like such that the vessel must be taken out of service.

Even after the vessel is taken out of service, irrespective of whether it will be condemned or refurbished, it must be decontaminated before it can be freely handled or disposed of. Most often the larger vessels are decontaminated and cup up for salvage of their metal value.

The present invention relates to a method of decontaminating vessels containing minor contaminating amounts of oxidizable liquid organic chemicals. More particularly, it relates to a method of decontaminating large vessels used for storing, transporting, or processing oxidizable liquid organic chemicals such as, for example, railroad tank cars, storage and process vessels, and portable tanks containing alkyl lead compounds, e.g., tetraalkyl lead compounds.

One way in which vessels can be decontaminated of oxidizable liquid organic chemicals is by chemical cleaning with an oxidizing agent. This method, however, is not always completely satisfactory because, as a result of, for example, a damaged lining, the contaminating chemical is typically absorbed deep in the vessel walls where the oxidizing agent cannot reach. Therefore, even after chemical cleaning, the deeply embedded residue eventually diffuses to the metal surface, thereby posing a future hazard. moreover, unless the oxidizing agent can effectively attack the vessel liner, this must also be removed. In addition, the spent oxidizing agent itself may pose environmental hazards; hence provisions must be made for safely disposing of this spent material.

The most effective method of decontamination is to heat the vessel to a high temperature for a given period of time in order to decompose the oxidizable liquid organic contaminant into combustion gases and/or solid inorganic metal oxides in the case where the contaminant contains a heavy metal. In the past, this heating has been accomplished by placing the entire vessel in an annealing furnace, i.e., a large chamber with natural gas burners placed around the periphery of the chamber. However, this mode of decontamination is unsatisfactory. Firstly, this method is not fuel efficient because the annealing furnace uses an excess of fuel to heat the empty space around the vessel to be decontaminated. In order to decontaminate the vessel effectively, the inside walls of the vessel should receive the maximum exposure to the heat. Such result is not obtained by directing the heat at the outside walls. Secondly, the combustion gases from the heating operation can contain solid contaminant by-products as well as particulates from the oxidized lining of the vessel, which must be filtered, and annealing furnaces are not equipped with the necessary filters.

SUMMARY OF THE INVENTION

It has now been found that vessels used for storing, transporting, or processing oxidizable liquid organic chemicals, particularly large vessels, can be decontaminated by introducing oxygen and a source of heat into the interior of the vessel. The heat emitted from the heat source efficiently decontaminates the vessel by heating the interior surfaces of the vessel to temperatures sufficient to volatilize substantially all and decompose at least a portion of the residual minor contaminating amount of organic chemical remaining in the vessel. Provisions are made for filtering the combustion gas which is exhausted from the vessel. A catalyst can be placed on the filter surface to aid in decomposing vapors of the organic chemical which are not completely oxidized.

This method is particularly useful to substantially remove all traces of alkyl lead from an obsolete, worn-out or damaged vessel containing such chemical to prevent health hazards associated with lead toxicity. Such vessels as wrecked tank cars (usually damaged beyond rebuilding) can be decontaminated of alkyl lead so that safe disposal of the salvage metal can be made. Portable vessels and process vessels (as well as rebuildable tank cars) can be decontaminated of alkyl lead, refurbished and placed back into service, thus saving the capital cost of replacing the vessel. Since alkyl lead plants are typically equipped with bag filters to treat lead furnace gases and process air, these filters can also be utilized to filter particulates issuing with the combustion gas exhausted from the vessel during the decontamination process. Further, lead dioxide contained in furnace dust and deposited on the surface of the filter acts as a catalyst for decomposing volatile alkyl lead remaining from partial combustion of the alkyl lead in the vessel.

BRIEF DESCRIPTION OF THE DRAWING

Further features and other objects and advantages of this invention will become apparent from the following detailed description made with reference to the drawing, which is a diagrammatic illustration of the described method for decontaminating vessels containing alkyl lead at an alkyl lead plant.

DETAILED DESCRIPTION OF THE INVENTION

According to the present invention, vessels, particularly large vessels, used for storing, transporting, or processing oxidizable liquid organic chemicals are decontaminated by a non-catalyst method. Before being taken out of service, the vessel is drained of the liquid organic chemical. The residue of organic chemical remaining in the vessel, which requires the described contamination procedure, is a minor contaminating amount of said organic chemical and includes vapors of the chemical within the vessel, the small amount of the liquid organic chemical which cannot be easily drained and the amount of such chemical which has seeped into the pores of the vessel surfaces.

Prior to initiating the decontamination process the vessel should be stripped of its jacket, insulation, etc., checked with an explosimeter for safety, air sampled, and washed, e.g., with sodium sulfide solution to remove as much as possible of the organic chemical remaining in the vessel. If the vessel is not housed in a building for containing combustion gases during decontamination, i.e., a baghouse, the vessel should be stripped of its exterior paint such as by sandblasting so that any environmentally unsafe combustion gases resulting from oxidation of the paint are not released to the atmosphere.

The decontamination process comprises:

(a) introducing oxygen and a heat source into the interior of the vessel, the emitted heat from the heat source being sufficient to heat the interior surfaces of the vessel to temperatures sufficient to volatilize substantially all and decompose at least a portion of the oxidizable liquid organic chemical contaminating the interior of said vessel, thereby to produce combustion gas within the vessel;

(b) exhausting from the vessel combustion gas resulting from the heating step;

(c) filtering particulates from the exhausted combustion gas and decomposing with heat any volatilized organic chemical remaining in the combustion gas exhausted from the vessel; and (d) venting to the atmosphere combustion gas substantially free of said particulates and oxidizable organic chemical.

The heating step (a) can be effected by installing a burner, e.g., a portable natural gas or liquid hydrocarbon fueled burner, within the interior of the contaminated vessel, e.g., at the mouth or in a port of the vessel. In another embodiment, superheated air, i.e., air having a temperature of about 900° C. is used. A portable burner such as a natural gas burner and a blower are connected to the vessel by means of a hole cut into the vessel. The burner is fired and the blower pushes superheated air which circulates through the interior of the vessel. When the burner is fired, the temperature of the interior surfaces of the vessel are raised from ambient to from about 200° C. to about 650° C., e.g., 300° C. to 600° C., commonly about 430° C., and maintained at this temperature for from about one to about 24 hours, e.g., one to four hours.

The heat emitted from the heat source into the interior of the vessel during the aforedescribed heating step should be sufficient to raise the interior surfaces of the vessel to temperatures sufficient to at least volatilize substantially all of the residue of oxidizable liquid organic contaminant contained in the vessel and decompose at least a portion of said contaminant. Preferably, the heat emitted is sufficient to decompose substantially all of the contaminant and any exterior paint (if this has not previously been removed by sandblasting). Volatilization of the oxidizable liquid organic contaminant effects the release of any such contaminant which has become embedded within the vessel walls. Irrespective of which heating method is utilized during the heating period, any paint remaining on the exterior of the vessel as well as the vessel lining are completely burned off.

Oxygen is introduced into the interior of the vessel simultaneously with the source of heat used to heat the interior of the vessel, i.e., combustion gas from the burner or superheated air, in at least stoichiometric amounts, i.e., the amount required to oxidize the residue of oxidizable organic chemical in the vessel. Preferably, substantially more than the stoichiometric amount of oxygen is used. The requisite amount of oxygen is provided usually by the superheated air or the oxygen used to burn the natural gas or liquid hydrocarbon fuel heat source, there being sufficient oxygen available in these gas streams to oxidize the residue of organic chemical contaminant in the vessel.

Combustion gas comprising the hot gases introduced into the interior of the vessel by the heat source and the gases resulting from oxidation of the oxidizable liquid organic contaminant fills the interior of the vessel. Following removal of any solid particulates from and decomposition of non-oxidized organic chemical in the combustion gas exhausted from the vessel, the combustion gas is environmentally safe for release into the atmosphere. The combustion gas then essentially comprises carbon dioxide, water vapor, and nitrogen.

In order to separate particulates, e.g., metal oxides, from the combustion gases exhausted from the vessel, such gases are filtered. The heat content of the combustion gas and/or filter, e.g., bag filter, is normally sufficient to oxidize (decompose) the volatilized organic chemical contaminant remaining in the exhausted combustion gas. In a further embodiment, the aforesaid filter can be impregnated with or contain a catalyst to assist in completely decomposing volatilized contaminants passing through the filter, thereby permitting the combustion gas to be vented into the atmosphere. Use of such a catalyst-containing filter is essential if there is incomplete oxidation of the oxidizable liquid organic chemical in the vessel and the heat content of the exhausted combustion gas and/or filter is insufficient to decompose (oxidize) the organic chemical in the exhausted gas. In the event that the aforedescribed filter is incapable of withstanding the high temperatures of the exhausted combustion gases, precooling of the exhaust gases may be necessary before they are filtered.

Among the catalysts that can be used to assist in decomposing alkyl lead compounds, e.g., tetraethyl and tetramethyl lead, is lead dioxide, which is found on the bag filters used to filter flue gas from the lead furnace of a tetraalkyl lead plant. See, for example, U.S. Pat. No. 4,176,165. Catalysts described in the art for oxidizing chemicals such as vinyl chloride at low temperatures, e.g., 100° C., are hydrated oxides of manganese, copper, nickel, and cobalt. See, for example, U.S. Pat. Nos. 4,039,623; 4,045,538; 4,065,543; and 4,059,677.

Large vessels decontaminated by the present invention typically have a volumetric capacity of from about 1,500 to about 36,000 liters. These vessels include railroad tank cars, portable tanks, process vessels and other large storage vessels which are taken out of service for refurbishing because of a damaged lining or other damage or taken out of service for disposal because the vessel is unsalvageable.

Tank cars are considered unsalvageable when the cost of repair is greater than the cost of replacement or when the car is obsolete or worn out. An unsalvageable truck undercarriage or other defective vital parts may also warrant disposal of an entire tank car.

In addition to decontamination prior to disposal, storage vessels most often require decontamination so that the lining can be replaced or for other refurbishing. Often a lining may become damaged because of outside damage to the vessel or as a result of gradual attack by the stored chemical. Since the cost of decontamination by the method of the present invention and then relining the vessel is a fraction of the cost of replacement, decontamination is advantageous for cost as well as safety reasons. Similarly, process vessels can be decontaminated.

Chemicals decontaminated by the present invention are oxidizable liquid organic chemicals that after combustion and possibly filtering leave gases containing material safe for the environment. Such chemicals include: alkyl lead, such as tetraethyl lead, tetramethyl lead and mixtures thereof; ethylene dibromide; ethylene dichloride; vinyl chloride; other organometallics and the like. After combustion, alkyl lead compounds leave volatile alkyl lead, lead dioxide, carbon dioxide, carbon monoxide, water and traces of other gases. Lead dioxide is a particulate that is required to be removed from the combustion gas and, therefore, must be filtered out of the gases exhausted from the decontaminated vessel.

The present invention is more particularly described in the following examples which are intended as being illustrative only.

EXAMPLE 1

Reference is now made to the figure. Portable tank 1 used for shipping and/or storing tetraethyl and tetramethyl lead is washed and checked with an explosimeter for safety and placed on cart 3 situated on rails 4 which leads into building 5. Building 5 is located at an alkyl lead plant near the bag filter house used to remove particulates from the furnace flue gases during alkyl lead production.

Portable tank 1 is rolled into building 5 with opening 6 in tank 1 directly below opening 7 in building 5. A portable burner (not shown) such as a natural gas burner is lowered by davit 8 through opening 7 and into tank 1. Opening 7 is then covered and the door is closed. The burner is then fired and heats the interior of the tank 1 to about 430° C. for about 1–4 hours. During this time paint on the exterior of tank 1 is completely burned off. Alkyl lead which is contained in tank 1 is volatilized and decomposed to drive all the alkyl lead from within the pores in the metal of the walls of the tank. Lining (also not shown) within the tank is also completely burned.

Combustion gases are withdrawn from building 5 via conduit 9 which leads to bag filter house 10 for removal of lead dioxide and other particulates formed during combustion. It can be noted that lead dioxide acts as a catalyst for decomposing volatilized alkyl lead compounds. Hence, volatilized alkyl lead remaining from incomplete combustion is decomposed on the surface of the bag filter owing to the action of the catalyst lead dioxide. Thus, gas exiting through stack 11 is free of pollutants.

Portable tank 1 which is salvageable is then removed from building 5, refurbished and prepared for painting and relining. Once the tank is relined, it can be placed back into service. Thus, a substantial savings over the cost of replacement is realized.

EXAMPLE 2

Railroad tank car 12 used for transporting tetraethyl and tetramethyl lead is emptied and removed from its undercarriage trucks. The tank is then air and explosimeter checked for safety. The jacket and insulation is then removed so the exterior of the tank can be sandblasted for removal of paint. This tank 12 then appears as depicted in the figure where it is shown loaded on wagon 13 near bag filter house 10 which is a part of an alkyl lead plant.

A portable heat source comprising blower 14 and burner 15 is connected to a hole 17 which is cut into tank 12. Superheated air is blown into tank 12 to raise the temperature in the tank to about 430° C. for about 1–4 hours, thereby burning the lining and volatilizing and decomposing the alkyl lead which is exhausted via conduit 16 to bag filter house 10 where particulates are removed from the exhaust gas. Gas exiting flue stack 11 is essentially free of pollutants.

Since in this case the tank car as a whole is too badly damaged, the tank and undercarriage truck is cut up for scrap metal which is safe for handling without being hazardous to human health or to the environment.

It can be seen from the description and examples that many modifications of the invention can be made without departing from the inventive concept. Accordingly, process vessels can be decontaminated and other oxidizable liquid organic contaminants can be decomposed by the present invention. Hence, these described embodiments are not intended to be limitations except insofar as those limitations are cited in the claims.

I claim:

1. A non-catalytic method of decontaminating vessels used for storing, transporting, or processing oxidizable liquid organic chemicals, which comprises:

a. introducing oxygen and a source of heat directly into the interior of the vessel, said vessel containing minor contaminating amounts of said liquid organic chemical, the heat emitted from said heat source being sufficient to heat the interior surfaces of the vessel to a temperature sufficient to volatilize substantially all and decompose at least a portion of said oxidizable liquid organic chemical contaminating the interior of said vessel, thereby to produce combustion gas within the vessel;

b. exhausting from the vessel combustion gas resulting from step (a);

c. filtering particulates from the exhausted combustion gas and decomposing with heat volatilized organic chemical remaining in the combustion gas exhausted from the vessel; and d. venting to the atmosphere combustion gas substantially free of said particulates and oxidizable organic chemical.

2. The method of claim 1 wherein the vessel is a large vessel having a capacity of from about 1,500 to 36,000 liters.

3. The method of claim 1 wherein the interior surfaces of the vessel are heated to from about 200° C. to about 650° C. for from about 1 to 24 hours.

4. The method of claim 3 wherein the oxidizable liquid chemical is alkyl lead, ethylene dibromide, ethylene dichloride, or vinyl chloride.

5. The method of claim 1 wherein the heat source is superheated air or a burner fueled by natural gas or liquid hydrocarbon fuel.

6. The method of claim 1 wherein the vessel is a railroad tank car.

7. A method of decontaminating large vessels used for storing, transporting or processing liquid alkyl lead which comprises:

a. introducing oxygen and a source of heat directly into the interior of the vessel, said vessel containing minor contaminating amounts of said liquid alkyl lead, the heat emitted from said heat source being sufficient to heat the interior surfaces of the vessel to a temperature sufficient to volatilize substantially all and decompose at least a portion of said alkyl lead contaminating the interior of said vessel, thereby to produce a combustion gas within the vessel;

b. exhausting from the vessel combustion gas and lead dixoide particles resulting from the volatilization and decomposition of the alkyl lead during step (a);

c. filtering lead dioxide particles and combustion gas exhausted from the vessel, thereby to separate said particles from the combustion gas;

d. decomposing with heat alkyl lead remaining in the combustion gas exhausted from the vessel; and e. venting to the atmosphere combustion gas substantially free of lead dioxide particles and alkyl lead.

8. The method of claim 7 wherein the alkyl lead is tetraethyl lead, tetramethyl lead or mixtures of tetraethyl lead and tetramethyl lead.

9. The method of claims 7 or 8 wherein the interior surfaces of the vessel are heated to from about 200° C. to about 650° C. for from about 1 to 24 hours.

10. The method of claim 7 wherein the heat source is superheated air or a portable burner fueled by natural gas or liquid hydrocarbon fuel.

11. The method of claim 7 wherein a bag filter is used for filtering the exhausted lead dioxide particles and combustion gas.

12. The method of claim 11 wherein the bag filter is also used to filter flue gas derived from the manufacture of alkyl lead.

13. The method of claims 1 or 4 wherein substantially all of the liquid organic chemical is decomposed in step (a).

14. The method of claim 7 wherein the vessel is selected from the group consisting of a railroad tank car, process vessel and a portable storage tank.

15. The method of claim 7 wherein substantially all of the alkyl lead is decomposed in step (a).

16. The method of claim 11, wherein a portion of the alkyl lead in the exhausted gas is decomposed by the action of a lead dioxide catalyst on the surface of the filter.

* * * * *